US012140017B2

(12) United States Patent
Fossaa et al.

(10) Patent No.: US 12,140,017 B2
(45) Date of Patent: Nov. 12, 2024

(54) PRESSURE SENSING PLUG FOR WELLHEAD/XMAS TREE

(71) Applicant: CONOCOPHILLIPS COMPANY, Houston, TX (US)

(72) Inventors: Oeystein Fossaa, Tananger (NO); Rune Romberg, Tananger (NO)

(73) Assignee: CONOCOPHILLIPS COMPANY, Houston, TX (US)

( * ) Notice: Subject to any disclaimer, the term of this patent is extended or adjusted under 35 U.S.C. 154(b) by 0 days.

(21) Appl. No.: 17/199,076

(22) Filed: Mar. 11, 2021

(65) Prior Publication Data

US 2021/0285318 A1 Sep. 16, 2021

Related U.S. Application Data

(60) Provisional application No. 62/988,185, filed on Mar. 11, 2020.

(51) Int. Cl.

| | |
|---|---|
| ***E21B 47/06*** | (2012.01) |
| ***E21B 33/03*** | (2006.01) |
| ***E21B 47/12*** | (2012.01) |

(52) U.S. Cl.

CPC ..... *E21B 47/06* (2013.01); *E21B 33/03* (2013.01); *E21B 47/12* (2013.01)

(58) Field of Classification Search

CPC ..... E21B 33/03; E21B 47/06; E21B 47/10; E21B 47/12; E21B 47/00

See application file for complete search history.

(56) References Cited

U.S. PATENT DOCUMENTS

| | | | | |
|---|---|---|---|---|
| 3,748,654 | A * | 7/1973 | Sutherland | G01F 15/063 377/13 |
| 2008/0060846 | A1* | 3/2008 | Belcher | E21B 43/08 175/25 |
| 2009/0101338 | A1* | 4/2009 | Flanders | E21B 47/117 166/250.01 |
| 2013/0027215 | A1 | 1/2013 | Kleppa | |
| 2013/0180726 | A1 | 7/2013 | Ross et al. | |
| 2013/0311093 | A1 | 11/2013 | Winters et al. | |

(Continued)

FOREIGN PATENT DOCUMENTS

| | | |
|---|---|---|
| NO | 333416 B1 | 6/2013 |
| WO | 2019178019 | 9/2019 |

OTHER PUBLICATIONS

International Search Report and Written Opinion for PCT/US2021/021966 mailed May 27, 2021; 11 pgs.

*Primary Examiner* — Caroline N Butcher

(74) *Attorney, Agent, or Firm* — CONOCOPHILLIPS COMPANY

(57) ABSTRACT

Pressure sensing plugs are used to check pressure in various void or cavities of a wellhead or Xmas tree of an active hydrocarbon well. Pressure sensing plugs (51) are provided at various points in the wellhead or Xmas tree (50). Each plug incudes a pressure transducer (39) and associated electronics allowing the pressure to be read by a hand held reader device. Alternatively, the plugs may include a radio transmitter for transmitting sensed data to a monitoring system via a wifi network or similar to a central control room on a hydrocarbon producing platform. In this way, the pressure at the various points in the wellhead/Xmas tree may be checked without exposing the cavity or void.

7 Claims, 4 Drawing Sheets

(56) References Cited

U.S. PATENT DOCUMENTS

| | | | | |
|---|---|---|---|---|
| 2014/0182846 | A1* | 7/2014 | Fischer | E21B 47/00 166/250.15 |
| 2015/0211512 | A1 | 7/2015 | Wiegman et al. | |
| 2017/0030160 | A1* | 2/2017 | Gray | E21B 47/06 |
| 2018/0094519 | A1 | 4/2018 | Stephens et al. | |
| 2018/0179854 | A1 | 6/2018 | Healy | |
| 2019/0056526 | A1 | 2/2019 | Krogenes et al. | |
| 2019/0345788 | A1* | 11/2019 | Park | E21B 47/06 |

* cited by examiner

PRESSURE SENSING PLUG FOR WELLHEAD/XMAS TREE

CROSS-REFERENCE TO RELATED APPLICATIONS

This application is a non-provisional application which claims benefit under 35 USC § 119(e) to U.S. Provisional Application Ser. No. 62/988,185 filed Mar. 11, 2020 entitled "PRESSURE SENSING PLUG," which is incorporated herein in its entirety.

STATEMENT REGARDING FEDERALLY SPONSORED RESEARCH OR DEVELOPMENT

None.

FIELD OF THE INVENTION

This invention relates to the pressure testing of barriers or seals in a Xmas tree or wellhead at the head of a well, e.g. a hydrocarbon well.

BACKGROUND OF THE INVENTION

Specialized plugs are installed on the Xmas tree (XMT) or wellhead (WH) of a well (e.g. a hydrocarbon well) for periodic checking of pressure as well as greasing, flushing and pressure bleed-off. The plugs communicate with different cavities/voids in the wellhead/XMT and the pressure check relates to the testing of barriers/seals. Normally there will be at least two plugs on opposite sides of the XMT/WH for each cavity/void to facilitate flushing.

A plug includes a check valve which is protected by a screw fitting cap (so-called vent cap). A pressure test operation involves removal of the vent cap if the plug/check valve assembly is OK (no leakage). Then a stinger tool is screwed onto the plug using the screw thread by which vent cap was previously attached. The stinger tool forms a seal with the plug and, as it is screwed in, depresses the check valve thus opening the tool to the pressure in the cavity/void being checked. The stinger tool will usually have a gauge to monitor the pressure, and an outlet for release of pressure.

This operation is time consuming and must be repeated for a number of plugs for each WH/XMT. It is estimated that 2-4 hours are used for this operation each year for each well.

There are some barrier issues related to use of stinger tools. The check valve in the plug may be leaking. Then an operator cannot continue the operation until the plug has been replaced. This may not be possible if barrier (seals in WH/XMT) are leaking and there is a barrier issue. A worse situation can arise where the check valve-a spring closed ball valve-will not seal after use, e.g. if it has been fouled by particulates in the fluid stream passing through the valve when it is opened by the stinger tool. In this event, the stinger tool cannot be removed.

BRIEF SUMMARY OF THE DISCLOSURE

The invention more particularly includes a method for checking pressure in one or more voids or cavities in a Xmas tree or wellhead of an active hydrocarbon well, the method, comprising (a) installing in the wellhead or Xmas tree, in communication with a void or cavity in which pressure is to be checked, an electronic pressure sensing device adapted to transmit sensed pressure data to a location not in communication with the said cavity or void in which pressure is to be checked; (b) at a location not in communication with the said cavity or void, receiving and reading the pressure data transmitted by the device.

Transmission of sensed data by the device may be performed in a number of different ways. Receiving or reading the pressure data sensed and transmitted by the device also may be performed in a number of different ways.

The device may incorporate a battery and radio transmitter for sending data wirelessly. The radio transmitter may be replaced by hard wired electrical contacts on the device, external to the void or cavity in which pressure is to be checked, at which the data can be read.

Alternatively, the device may be passive and the sensor powered by an external source, e.g. by inductive coupling, when it is to be read.

As regards reading the sensed data from the device, an electronic reader device (e.g. hand held) may be brought into contact with or into the proximity of the sensing device, without the reader being in communication with the said cavity or void in which pressure is to be checked. The reader may read data by direct contact with terminals on the device, or may receive data wirelessly. The reader may or may not power the device when it is brought into proximity or into contact with the device.

If a radio transmitter is incorporated into the sensing device, data may be transmitted to a central a monitoring system, without the need for a reader to be brought up to the device each time pressure data is to be read. In this event, the sensed data may be transmitted by short range radio (e.g. using a Bluetooth system) to a hub near the wellhead or Xmas tree (e.g. within 100 m, optionally within 50 m or 10 m).

The data may be transmitted to a central monitoring system, optionally via the cloud. The hub may be in communication with a plurality of nearby wellheads or Xmas trees. The monitoring system may have a user interface in a control room of a production platform.

If a reader device is used, it be hand-held and may include an electronic display of pressure. The reader may include a data store in which the pressure reading or readings from the or each plug may be stored.

The sensing device may have identification data stored in it which may be read by the reader device and may be stored by the reader device.

The invention also encompasses a wellhead or Xmas tree having installed within it at least one pressure sensing device in communication with void or cavity of the wellhead of Xmas tree, wherein the device comprises: (a) pressure sensing element, (b) an electronic circuit either (i) having terminals for the supply of power and/or (ii) capable of being inductively powered from outside the wellhead or Xmas tree. The pressure sensing device may include features enabling any of the functionality described above, e.g. terminals for reading data from the device, and/or a transmitter for transmitting a reading of pressure in the form of a radio signal.

Examples and various features and advantageous details thereof are explained more fully with reference to the exemplary, and therefore non-limiting, examples illustrated in the accompanying drawings and detailed in the following description. Descriptions of known starting materials and processes can be omitted so as not to unnecessarily obscure the disclosure in detail. It should be understood, however, that the detailed description and the specific examples, while indicating the preferred examples, are given by way of illustration only and not by way of limitation. Various substitutions, modifications, additions and/or rearrangements within the spirit and/or scope of the underlying inventive concept will become apparent to those skilled in the art from this disclosure.

As used herein, the terms "comprises," "comprising," "includes," "including," "has," "having" or any other variation thereof, are intended to cover a non-exclusive inclusion. For example, a process, product, article, or apparatus that comprises a list of elements is not necessarily limited only those elements but can include other elements not expressly listed or inherent to such process, process, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

The term substantially, as used herein, is defined to be essentially conforming to the particular dimension, shape or other word that substantially modifies, such that the component need not be exact. For example, substantially cylindrical means that the object resembles a cylinder, but can have one or more deviations from a true cylinder.

Additionally, any examples or illustrations given herein are not to be regarded in any way as restrictions on, limits to, or express definitions of, any term or terms with which they are utilized. Instead these examples or illustrations are to be regarded as being described with respect to one particular example and as illustrative only. Those of ordinary skill in the art will appreciate that any term or terms with which these examples or illustrations are utilized encompass other examples as well as implementations and adaptations thereof which can or cannot be given therewith or elsewhere in the specification and all such examples are intended to be included within the scope of that term or terms. Language designating such non-limiting examples and illustrations includes, but is not limited to: "for example," "for instance," "e.g.," "In some examples," and the like.

Although the terms first, second, etc. can be used herein to describe various elements, components, regions, layers and/or sections, these elements, components, regions, layers and/or sections should not be limited by these terms. These terms are only used to distinguish one element, component, region, layer or section from another. Thus, a first element, component, region, layer or section discussed below could be termed a second element, component, region, layer or section without departing from the teachings of the present inventive concept.

While preferred examples of the present inventive concept have been shown and described herein, it will be obvious to those skilled in the art that such examples are provided by way of example only. Numerous variations, changes, and substitutions will now occur to those skilled in the art without departing from the disclosure. It should be understood that various alternatives to the examples of the disclosure described herein can be employed in practicing the disclosure. It is intended that the following claims define the scope of the disclosure and that methods and structures within the scope of these claims and their equivalents be covered thereby.

BRIEF DESCRIPTION OF THE DRAWINGS

A more complete understanding of the present invention and benefits thereof may be acquired by referring to the follow description taken in conjunction with the accompanying drawings in which.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

Figure 1:
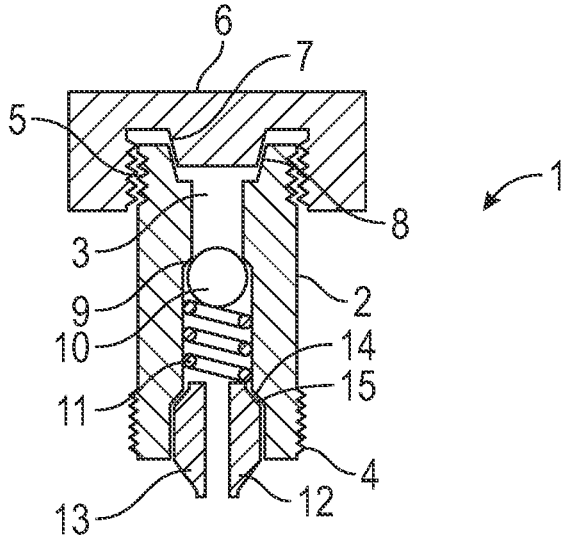
FIG. 1 is a sectional view through a known type of plug including check valve and vent cap.

As shown in section in in FIG. 1, a known type of plug 1 with check valve comprises a generally cylindrical body 2 with bore 3 through it. At one end of the body 2 is an external thread 4 for mounting the plug in a threaded channel in a wellhead (WH) or Xmas tree (XMT) communicating with an internal void of the wellhead/XMT.

At the opposite end of the body 2 is another external thread 5 to which is mounted an internally threaded vent cap 6. The vent cap includes a sealing projection 7 which engages with and forms a seal with a flared seal portion 8 of the bore 3 when the vent cap 6 is in place.

Within the bore 3, and normally retained against internal sealing shoulder 9, is a valve ball 10 (check valve). Biasing the valve ball 10 against shoulder 9 is a valve spring 11, which is itself held in place by insert 13 in the bore 3. The ball will of course also in use be biased against the shoulder by any pressure within the wellhead/XMT in which the plug is mounted. The insert 13 also has an outer conical external sealing surface 12 which, when the plug is installed in a wellhead/XMT, seals against a mating surface of the wellhead/XMT. The insert 13 also has an inner conical sealing surface 15 which seals against a corresponding inclined shoulder 14 in the bore 3.

The plug 1 thereby provides a seal with the wellhead/XMT which is open-able by means of the ball 10 and shoulder and a second openable seal by means of the flared portion 8 and the projection 7 of the vent cap 6.

Figure 2:
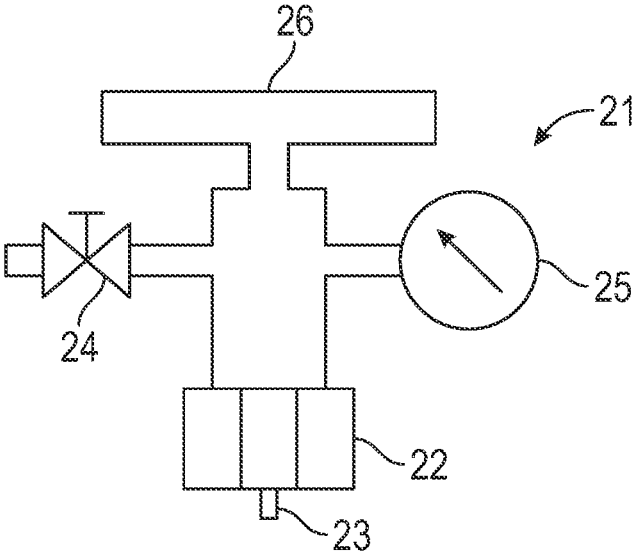
FIG. 2 is a highly schematic representation of a known type of stinger tool for reading pressure.

Referring to FIG. 2, a stinger device 21 for mounting on the plug 1 in place of the vent cap 6 is shown schematically. The stinger device 21 comprises an internally threaded mounting portion 22 for mounting on the thread 5 of the plug 1 in place of the vent cap 6. Inside this mounting portion 22 is a sealing projection (not shown) for forming a seal with the flared surface 8 of the plug 1, and a needle 23 for depressing and thereby opening the ball valve in the plug 1. An internal channel (not shown) is open to the interior of the mounting portion 22.

The internal channel (not shown) communicates with a pressure gauge/display 25, whereby the pressure of the WH/XMT void may be sensed when the device is in place on a plug. The internal channel also communicated with a manually controllable valve 24 which may be used to bleed off pressure if necessary.

A handle 26 is provided to assist screwing the device into place on a plug.

In use, when pressure is to be tested, the vent cap 6 is unscrewed. The stinger device 21 is then screwed onto the thread 5 in place of the vent cap 6. The stinger forms a seal with the flared portion 8 of the bore whilst depressing the valve ball 10 to open it. Pressure may then be read on gauge 25 and, if necessary, bled off using the manual valve 24.

Figure 3:
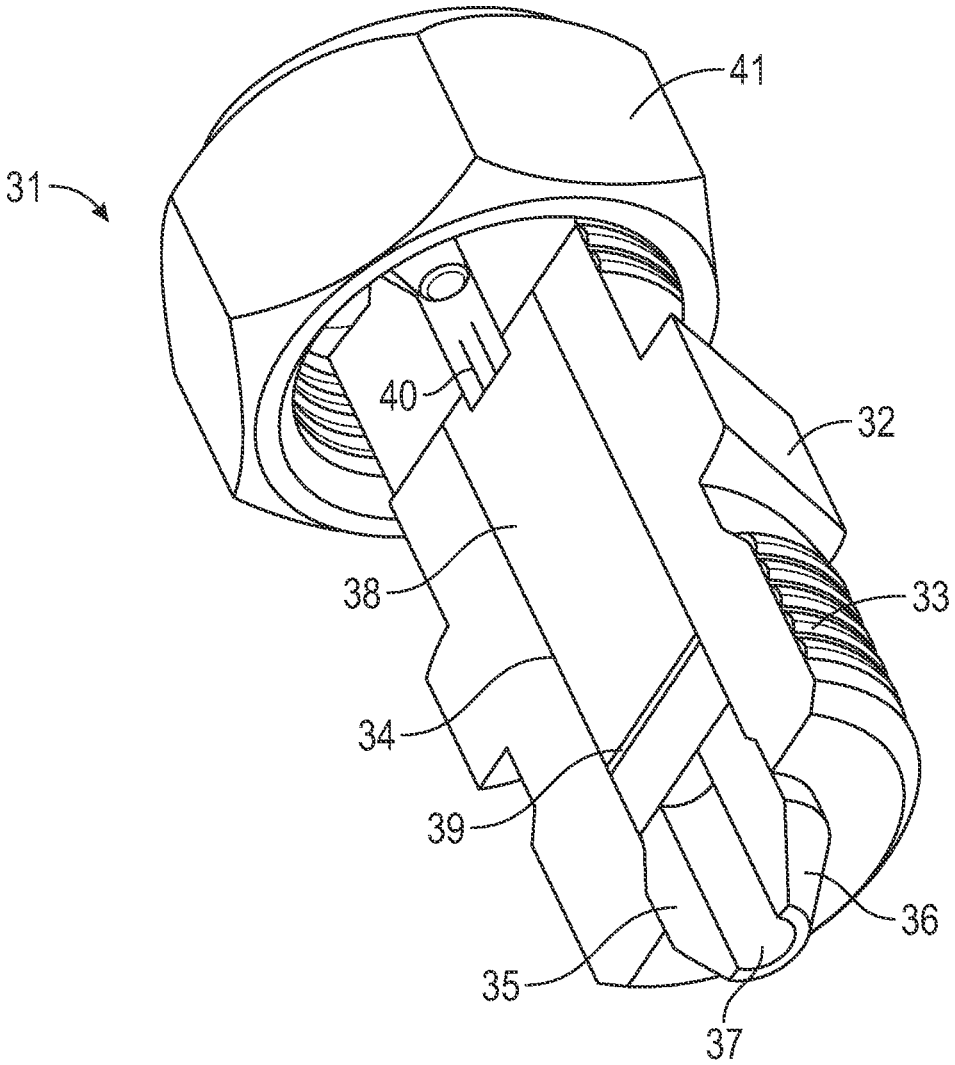
FIG. 3 is a perspective part-sectional view of a non-invasive type of pressure sensor for use in the invention.

Referring to FIG. 3, which is a partly schematic, part-sectional perspective view, a pressure sensing plug 31 in accordance with the invention is shown. The sensing plug 31 comprises a main body (metal plug) 32 having an external thread 33 at one end for mounting in a wellhead housing/XMT in the same way as a conventional pressure sensing plug. Also similar to a conventional plug, the main body 32 is formed with a central bore 34 in one end of which is located an insert 35. The insert 35 has a tapered sealing surface 36 for sealing against a complementary surface of the wellhead/XMT, and the insert also has a bore 37.

An electronics module 38 occupies the majority of the central bore 34 of the plug. The majority of the electronics module 38 is shown in a highly schematic way in FIG. 3 but an important part of it is a pressure sensing element (in this case a diaphragm) 39 at one end of the module 38. The pressure sensing diaphragm is in communication with the bore 37 of the insert 35.

At the opposite end of the module are terminals 40.

Mounted by means of cooperating screw threads to the main body 32 is a cap 41, which seals the central bore 34 by means of co-operating tapered surfaces, as in the conventional plug, thereby providing a back-up seal.

The electronics module 38 and pressure sensor 39 are in themselves conventional and widely available, so the details of these components are not provided here.

In use, when pressure is to be read, the cap 41 is first unscrewed a little to check that there is no leakage through the plug. If no leakage is detected the cap is fully removed, exposing the terminals 40. A reader/power supply (not shown in FIG. 3) having complementary terminals is brought up to the exposed terminals 40. In this way the electronic module 38 is powered. When the module 38 is powered and diaphragm 39 is subjected to a pressure difference between its two sides, this causes the module to create an analog or digital electrical output on the terminals 40.

The pressure reading output on terminals 40 is read by reader device which then displays or stores the values and/or communicates them to a remote display and/or data storage facility.

In an alternative design of plug, the electronics module 38 has the capability to be powered without direct contact using known technology for this purpose, e.g. inductive coupling. The reader device (reference 52 in FIG. 4) in this case includes the capacity to transfer power to the module 38, e.g. by inductive coupling. In the alternative design, the module 38 and reader may also have the facility to transmit and receive sensed pressure data, e.g. by radio signal. In the alternative design, it is not necessary to remove the cap 41 in order to read the sensor, and thus further time savings may be made.

Figure 4:
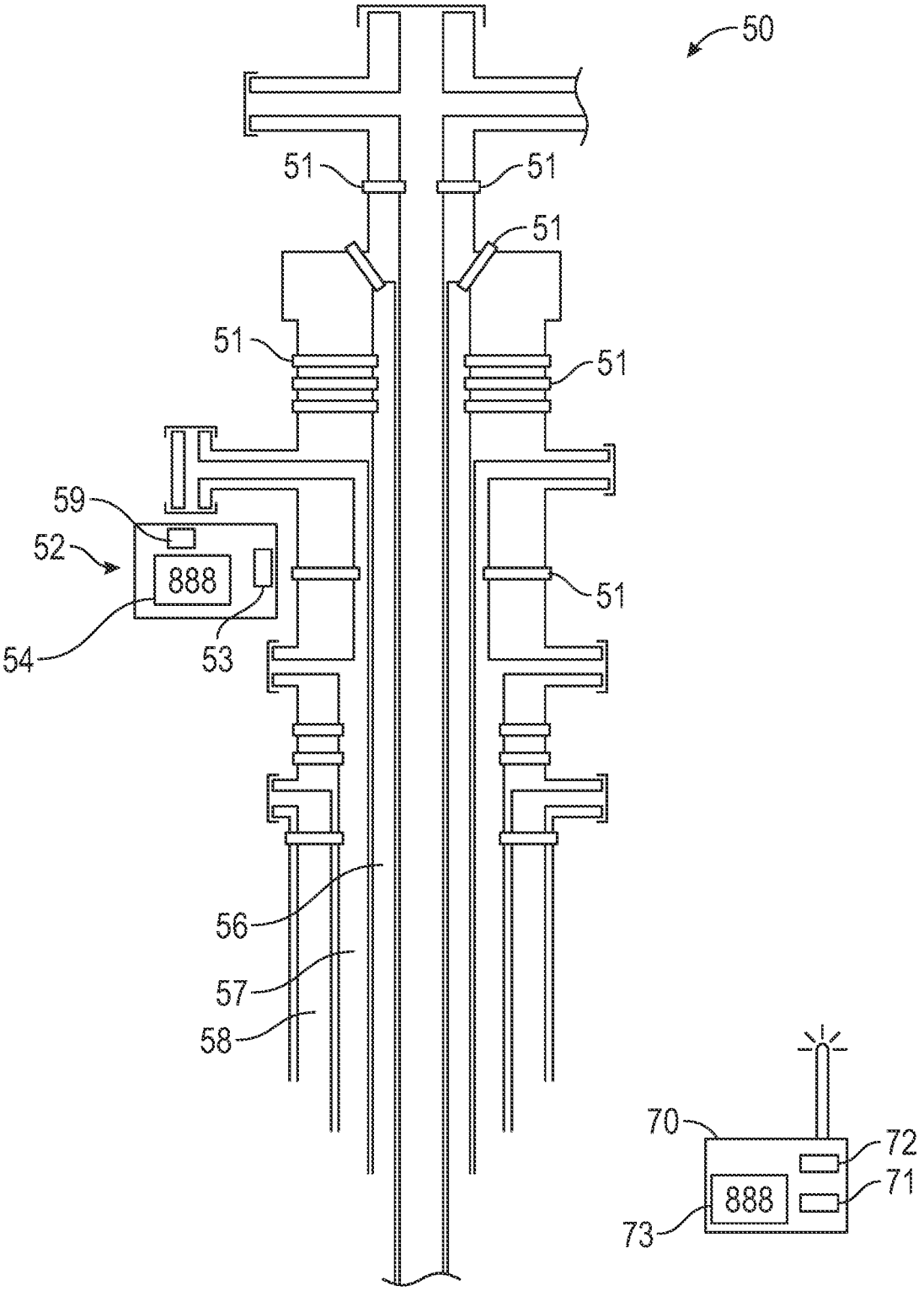
FIG. 4 is a highly schematic sectional view of a wellhead and Xmas tree with pressure sensor plugs, together with a schematic representation of a reader device.

FIG. 4 shows a wellhead and Xmas tree, shown generally at 50, with a number of pressure sensing plugs 51 installed in it, each communicating with various different cavities/voids within the wellhead 50. A detailed description of the various parts of the wellhead is not necessary since it is a conventional piece of equipment. However, the sensor plugs 51 are arranged to detect pressure leakage between various annuli 56, 57, 58 of the well and with other voids and cavities in the wellhead and Xmas tree. FIG. 4 omits for the sake of clarity a large number of internal components in the XMT/WH which define further voids/cavities as is conventional in this field. The pressure in some or all of these voids/cavities is of interest and therefore some or all of them have one or more plugs 51 associated with them.

Figure 5:
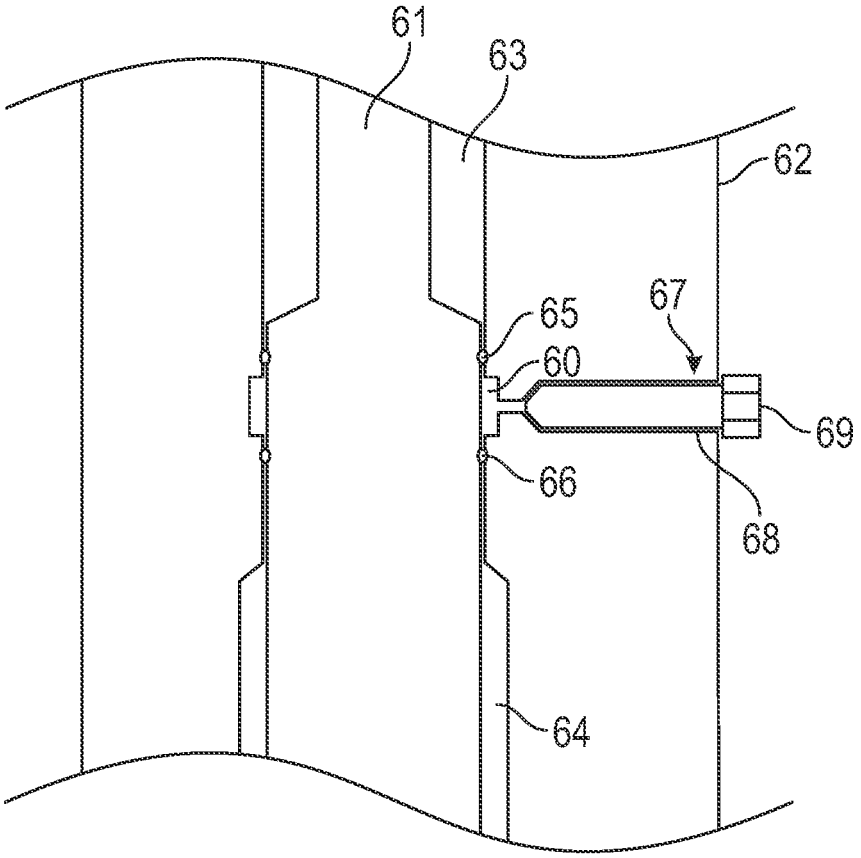
FIG. 5 is a schematic detail of an exemplary plug in a section of wellhead.

FIG. 5 shows schematically some detail from a wellhead, including an example of a cavity 60 in which pressure is to be sensed. The illustrated part of the wellhead comprises a generally cylindrical central member 61 and an outer tubular member 62. The central and outer members together define a number of passages and channels which are omitted for clarity, but two annular spaces are shown: an upper space 63 and a lower space 64. These two annular spaces 63, 64 are separated from each other by two annular seals 65, 66. Between the seals the small annular cavity 60 is provided specifically to allow for checking the seals by sensing the pressure between them.

A pressure plug shown generally at 67 is inserted with a sealing engagement into a bore 6 in the outer member 62 of the wellhead. The details of the plug are not shown but it is of the design shown in FIG. 3, and includes a vent cap 69.

Returning to FIG. 4, it can be seen that there are a large number of pressure plugs 51 and therefore that interrogating them all by unscrewing vent caps and screwing on a conventional stinger device can take a considerable amount of time, in addition to the possibility (multiplied by the number of plugs) for a check valve to become obstructed by dirt or debris when being read.

Also shown in FIG. 4 in highly schematic form is a reader device 52 which includes an electronic module 53 including a facility for reading a pressure sensor plug either via radio (e.g. e.g. using RFID technology) or via electrical contacts on the reader and plug (not shown). A display 54 showing the pressure reading is provided on the reader device.

In a modification, the reader may also include an electronic data storage facility such that all readings from a wellhead or from a number of wellhead may be stored and subsequently downloaded to a central data storage facility. The electronics modules of individual pressure sensing plugs may have unique identification data stored in them which may be read automatically by the reader and stored together with the pressure reading and time and date, etc.

The pressure sensing plug shown in FIG. 3 may be entirely passive. In this event the reader device 52 may also include an induction power source 59 such that the interrogation of the sensing plug involves powering the circuitry in the sensing plug from the reader.

In any of the above designs of reader and plug, the result is that, in use, the reader is simply placed against the plug and activated to produce a display of pressure on the reader device. Even if a cap has to be removed first, this operation is clearly considerably faster that unscrewing a cap and screwing on a stinger pressure reading device. Furthermore, the risks associated with physically opening a valve every time pressure needs to be sensed would be avoided. Given the number of pressure sensing plugs which need to be checked, it can be seen that the probabilities of a problem occurring with a valve are multiplied.

In a further alternative design of plug, the electronics module 38 includes a power supply (e.g. a small battery) and a short range radio transmitter. The transmitter may transmit sensed pressure information to a local hub 70 (see FIG. 4). The local hub 70 includes a radio receiver 71 for receiving data from the sensor. It may also include a display 73 and/or a radio transmitter 74. The hub may transmit data for storage in the cloud or to a computer network on the platform. The hub 70 may send signals to the sensor prompting it to make a pressure reading and transmit pressure data. In a further alternative. The hub may receive data from a plurality of wellheads or Xmas trees, e.g. on one hydrocarbon producing platform. In this system, there is no need manually to apply a reader unit to the pressure sensing plug, resulting in further time saving and convenience. It may also be possible to have continuous readings of pressure from plugs in a number of wellheads or Xmas trees, e.g. in a control room of a production platform.

In closing, it should be noted that the discussion of any reference is not an admission that it is prior art to the present invention, especially any reference that may have a publication date after the priority date of this application. At the same time, each and every claim below is hereby incorporated into this detailed description or specification as additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The invention claimed is:

1. A method for pressure testing barriers or seals in a Xmas tree and wellhead of an active hydrocarbon well associated with a production platform, the method comprising:

installing in the wellhead or Xmas tree, in communication with a void or cavity in which pressure is to be checked, an electronic pressure sensing device, the said void or cavity being separated by seals from two annular spaces, and the said device being adapted and arranged to check the said seals by sensing pressure between them, thereby to detect pressure leakage between annuli of the well, the said device also being arranged to transmit sensed pressure data to a location not in communication with the said cavity or void in which pressure is to be checked, wherein the said pressure sensing device includes contact terminals protected by a removable cap and wherein said contact terminals comprise the said location to which sensed pressure data is transmitted;

sensing pressure with said electronic pressure sensing device in said void or cavity to generate sensed pressure data, thereby detecting pressure leakage between annuli of the well;

transmitting said pressure data to said contact terminals; and reading the said pressure data at said contact terminals by means of a hand held reader device that includes complementary contact terminals whereby, when the sensor contact terminals and reader contact terminals are brought into contact, and data is transferred from the sensing device to the reader device.

2. A method as claimed in claim 1 wherein the pressure sensing device is a passive device and the reader incorporates a power source, wherein the method includes powering the sensing device by bringing the reader device into contact with the sensing device.

3. A wellhead and Xmas tree of an active hydrocarbon well associated with a production platform, the wellhead and Xmas tree, wherein the well and Xmas tree comprise:

at least one pressure sensing device in communication with a void or cavity of the wellhead or Xmas tree, the said void or cavity being separated by seals from two annular spaces, and the said device being arranged to check the said seals by sensing pressure between them, and thereby to detect pressure leakage between annuli of the well, wherein the pressure sensing device comprises:

a pressure sensing element and an associated electronic circuit, and a method of transmitting pressure data comprising electrical contact terminals external to the void or cavity to which pressure data are transmitted, wherein the said contact terminals are protected by a removable cap.

4. A wellhead or Xmas tree as claimed in claim 3, wherein the electronic circuit receives power from said contact terminals external to the void or cavity.

5. A wellhead or Xmas tree as claimed in claim 3 in combination with an electronic reader device for reading pressure from the pressure sensing device by contact with said contact terminals of the pressure sensing device.

6. A combination as claimed in claim 5, wherein the electronic reader device includes an electronic display to show a reading of sensed pressure and/or a data store in which the pressure reading from the sensing device may be stored.

7. A combination as claimed in claim 5 wherein the pressure sensing device is a passive device and the reader incorporates a power source.

* * * * *